US005303755A

United States Patent [19]

Poling

[11] Patent Number: 5,303,755

[45] Date of Patent: Apr. 19, 1994

[54] WORKBENCH SYSTEM

[76] Inventor: Douglas E. Poling, 515 Dorchester Rd., Catonsville, Md. 21228

[21] Appl. No.: 102,380

[22] Filed: Aug. 5, 1993

[51] Int. Cl.[5] ..... B25H 1/00

[52] U.S. Cl. ..... 144/286 A; 83/471.3; 83/477.2; 83/574; 144/286 R; 144/1 R

[58] Field of Search ..... 182/155; 83/477.2, 471.2, 83/471.3, 574; 144/1 R, 1 E, 1 F, 286 R, 286 A

[56] References Cited

U.S. PATENT DOCUMENTS

| | | | |
|---|---|---|---|
| 4,265,283 | 5/1981 | Nash et al. | 144/286 R |
| 4,281,570 | 8/1981 | Hill | 144/286 R |
| 4,465,114 | 8/1984 | Schumacher | 83/574 |
| 4,807,506 | 2/1989 | Audet | 144/286 R |
| 4,934,423 | 6/1990 | Withrow | 144/286 R |

*Primary Examiner*—W. Donald Bray

*Attorney, Agent, or Firm*—Morton J. Rosenberg; David I. Klein

[57] ABSTRACT

This invention provides for a portable workbench system (10) which may be used on-site in construction projects. The workbench system (10) permits cutting of workpieces (12) on-site without the necessity of removing the workpieces (12) to a central location. The workbench system (10) provides for a workbench frame (16) having a workpiece positioning member (28) extending in a longitudinal direction (18). A first power saw mounting mechanism (54) allows for fixing the position of a portable power saw (14) above the workpiece positioning member (28). Additionally, a second power saw mounting mechanism (80) is provided for adjustably and fixedly positioning the portable power saw (14) at least partially below the workpiece positioning member (28) in order to allow the user to either cut a workpiece (12) from above or below the workpiece positioning member (28).

19 Claims, 4 Drawing Sheets

WORKBENCH SYSTEM

BACKGROUND OF THE INVENTION

1. Field of the Invention

This invention pertains to workbench systems which permits a variety of operations to be accomplished and in particular cutting of differently sized workpieces from either above or below a stabilizing and positioning planar member. This invention relates to portable workbench systems which may be used for on-site cutting operations without the necessity of carrying the workpieces to a central location for such operations. In particular, this invention directs itself to a workbench system which includes a workbench frame having leg members for interfacing with a base surface and includes a substantially planar positioning member which extends throughout the longitudinal length of the workbench system. More in particular, this invention directs itself to a workbench system which has a plurality of stabilizing and positioning orientations for a portable power saw. Still further, this invention relates to a workbench system where a portable power saw may be mounted above a particular workpiece positioning planar member in a variety of longitudinal displacement locations as well as being able to be vertically adjustable above the workpiece. Still further, this invention directs itself to a workbench system where a portable power saw may be secured beneath a planar positioning member for passage of a rotatable blade through a slot formed through the positioning member for cutting a workpiece mounted on top of the positioning member.

More in particular, this invention directs itself to a workbench system which allows the user to arcuately direct the saw blade against a workpiece edge for mitering or otherwise providing an inclined cut to the workpiece.

2. Prior Art

Workbench systems of a portable nature are known in the art. Additionally, knock-down workbenches for use with power tools are also known in prior art systems. The closest prior art known to the Applicant includes U.S. Pat. Nos.: 5,165,317; 4,161,974; 4,494,431; 4,133,237; 4,958,544; 4,465,114; 4,827,819; 3,727,502; 2,803,271; 4,281,570; 3,734,151; and, 4,681,305. In some prior art systems as that shown in U.S. Pat. No. 5,165,317, such provide for knock-down workbenches for use with power tools. These prior art systems may include portable circular saws which may be secured to a base plate and are slidably carried by rails. However, such power saw securement mechanisms are mounted above a carriage and may alternatively be mounted below the workbench structure for use as a table saw, but such systems do not disclose a pivotal suspension mounting above the workbench surface as is provided by the inventive concept of the subject system.

In other prior art systems such as that shown in U.S. Pat. No. 4,161,974, there are portable bench frames for use with woodworking power tools. Such workbench frames support transverse beams through girder structures located on opposing ends thereof. The transverse beams are provided with runners from which are suspended motors and carriage assemblies of a radial arm of a circular saw which may be releasably locked in a selected location along the beam and rotated however, such prior systems do not provide for the mounting of the saw beneath the work table surface nor do such prior art systems disclose the use of a common mounting plate to facilitate an alternate mounting orientation scheme.

SUMMARY OF THE INVENTION

A workbench system is provided for cutting workpieces placed thereon with a portable power saw. The workbench system includes a workbench frame having a plurality of leg members interfacing with a base surface and a workpiece positioning member extending in a longitudinal direction. A power saw securement mechanism is releasably coupled to the workbench frame for predeterminedly mounting the power saw to the workbench frame. A first power saw mounting mechanism for adjustably and fixedly positioning the portable power saw above the workpiece positioning member is further provided in combination with a second power saw mounting mechanism for adjustably and fixedly positioning the portable power saw at least partially below the workpiece positioning member.

DESCRIPTION OF THE PREFERRED EMBODIMENTS

Figure 1:
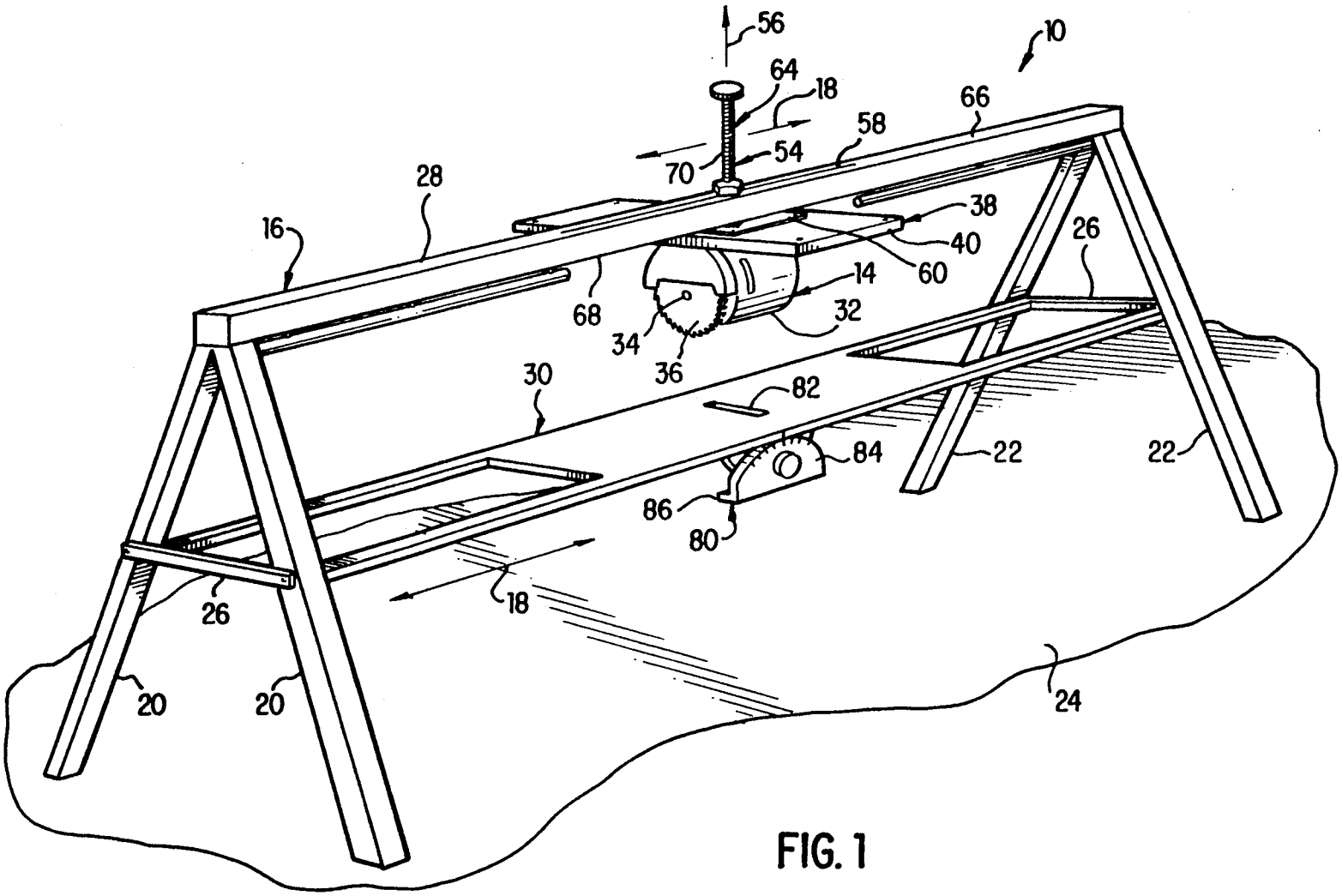
FIG. 1 is a perspective view of the workbench system of the subject invention concept.

Referring now to FIGS. 1–4, there is shown workbench system 10 for cutting workpieces 12 placed thereon with a circular portable power saw 14. The concept of workbench system 10 is to provide improvements in cutting operations with regard to on-site board or workpiece cutting. In use, workbench system 10 is substantially portable in nature and allows a user to accomplish a plurality of cutting operations on-site in construction areas and even in remote areas. In this manner, workpieces or boards 12 do not have to be measured, dimensioned, or otherwise prepared prior to removal from the on-site construction area for a particular cutting operation.

Through use of workbench system 10 as will be described in following paragraphs, the user may as one example be building a portion of an edifice in a remote area and dimension the particular workpiece or board 12 as a function of an interface with other elements of the edifice being constructed. The workpiece 12 is then merely taken to portable workbench system 10 on-site and the board 12 cut to appropriate dimensions. The workpiece 12 may then be placed into the appropriate interfacing relationship with the edifice being constructed. In this manner, workpieces 12 do not have to be removed from the construction site for a construction operation and labor time is optimized with a resulting lowering of overall costs.

Figure 2:
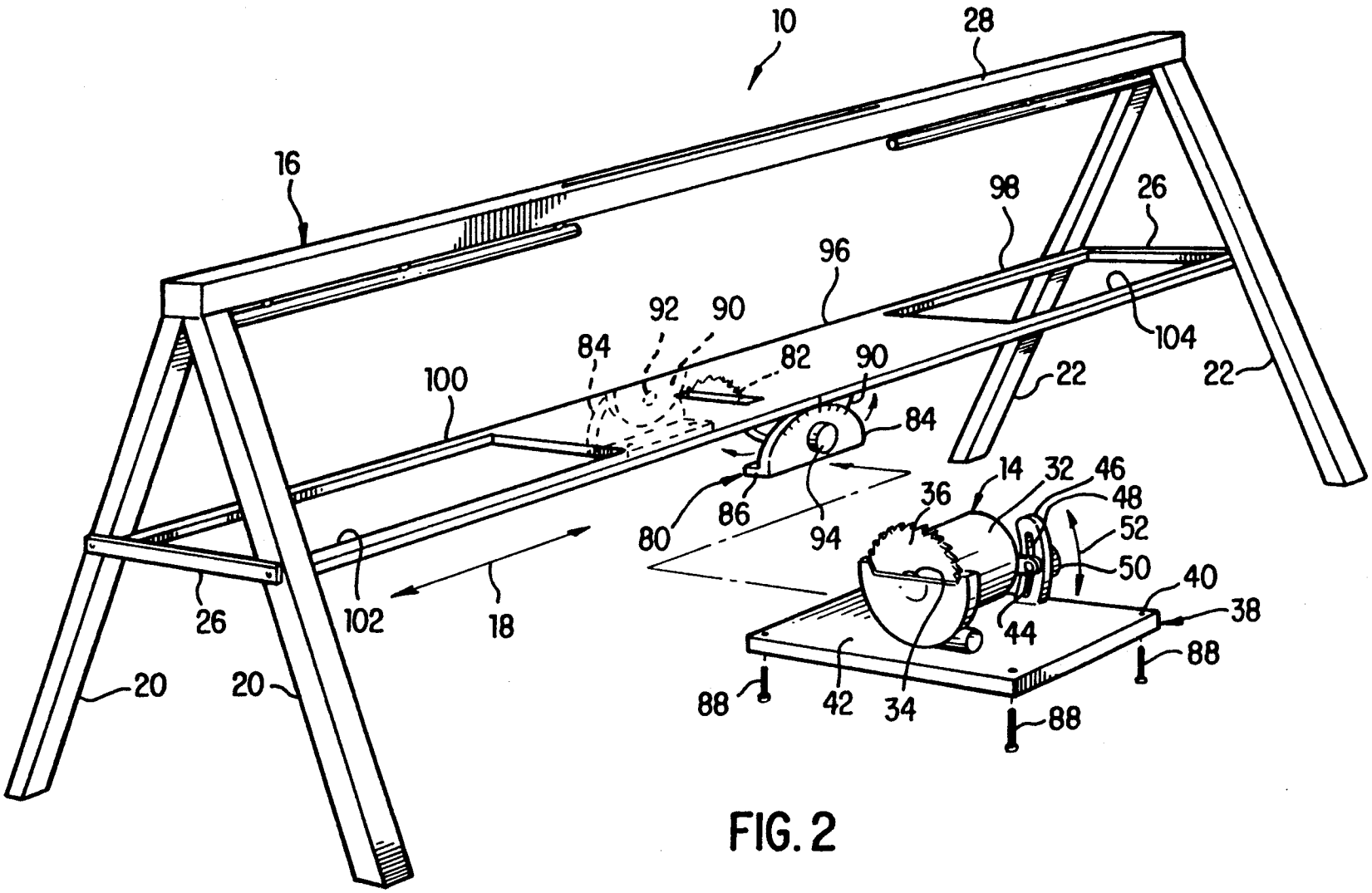
FIG. 2 is a perspective view of the workbench system partially in blow out showing a power saw securement mechanism adapted for insertion below a workpiece positioning member.
Figure 4:
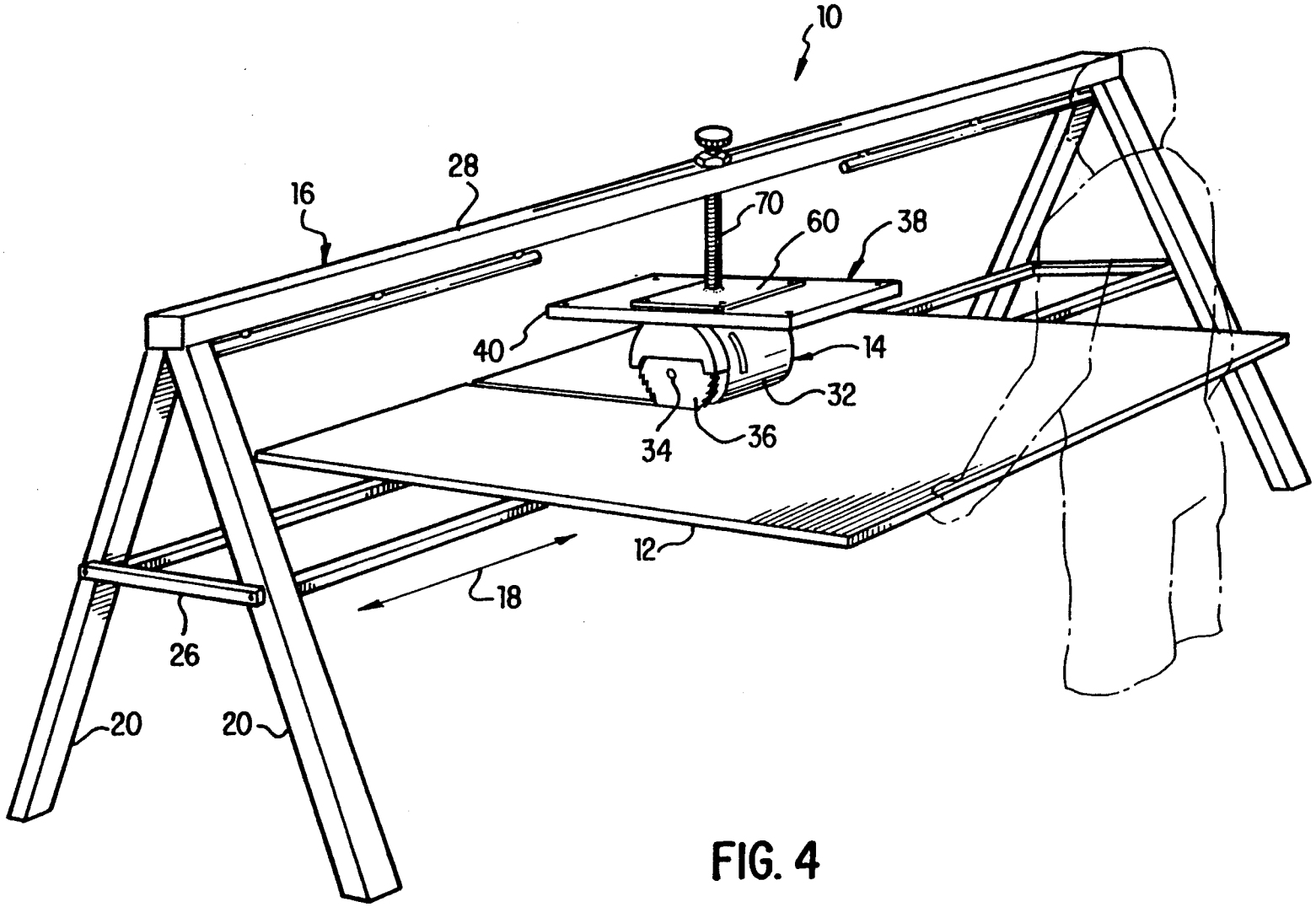

Workbench system 10 as is shown in FIGS. 1, 2 and 4 includes workbench frame 16 which extends in longitudinal direction 18. Workbench frame 16 includes first leg member set 20 and second leg member set 22 which are mounted on opposing longitudinal ends of workbench frame 16 as is clearly seen in FIGS. 1 and 2. The lower ends of first and second leg set members 20 and 22 interface and lie contiguous with base surface 24 for providing a stabilizing surface area or platform for workbench system 10. As is seen, each of first and second leg sets 20 and 22 are composed of a pair of leg members which form an inclined set of members having an apex for providing a stabilized mounting. The particular number of leg members for each of first and second leg sets 20 and 22 is not important to the inventive concept as herein described with the exception that such provide a stabilized mounting for workbench system 10 on surface 24. Leg set members 20 and 22 may be formed of a rigid material composition such as wood, steel, rigid plastic or some like material, once again not important to the inventive concept as herein described with the exception that such have sufficient structural integrity to accept the loads applied.

Each of leg set members 20 and 22 are joined together at a midpoint by transverse struts 26 which provide a rigidifying structural component to maintain workbench system 10 in a one-piece construction during operation. Workbench frame 16 further includes upper longitudinally directed frame bar member 28 secured on opposing longitudinal ends to first and second leg set members 20 and 22 at an apex area as is seen. Fixed coupling may be through nailing, bolting, adhesive bonding or some like technique.

Workbench system 10 and in particular workbench frame 16 includes workpiece positioning member 30 extending in longitudinal direction 18 and in itself being secured or coupled to opposing first and second leg set members 20 and 22. In this manner, workbench frame 16 in cross-section takes on a somewhat A-shaped contour.

One of the basic concepts associated with workbench system 10 is to provide a portable system whereby workpiece 12 which may be in the form of a board as shown in FIG. 4, may be positionally located for a cutting operation. Additionally, in order to provide maximum flexibility in any cutting operation, another important concept is to allow workpiece 12 to be mounted on workbench frame 16 in a manner that such may be cut by circular portable power saw 14 from above the mounting position or alternatively from below the mounting position. Portable power saw 14 may be any commonly used portable power saw system commercially available. Power saw 14 includes the usual drive or saw motor 32 having shaft 34 for driving power saw blade 36 in a rotary displacement with respect to power saw shaft 34. No further discussion of portable power saw 14 will be made due to the fact that such is common in the prior art and the only elements being referred to are those which are needed for the description of the positioning of portable power saw 14 on workbench frame 16 as will be detailed in following paragraphs.

Workbench system 10 includes power saw securement mechanism 38 releasably couplable to workbench frame 16 for predeterminedly mounting power saw 14 to workbench frame 16 in a plurality of positional orientations and locations as will be described in following paragraphs.

Figure 3:
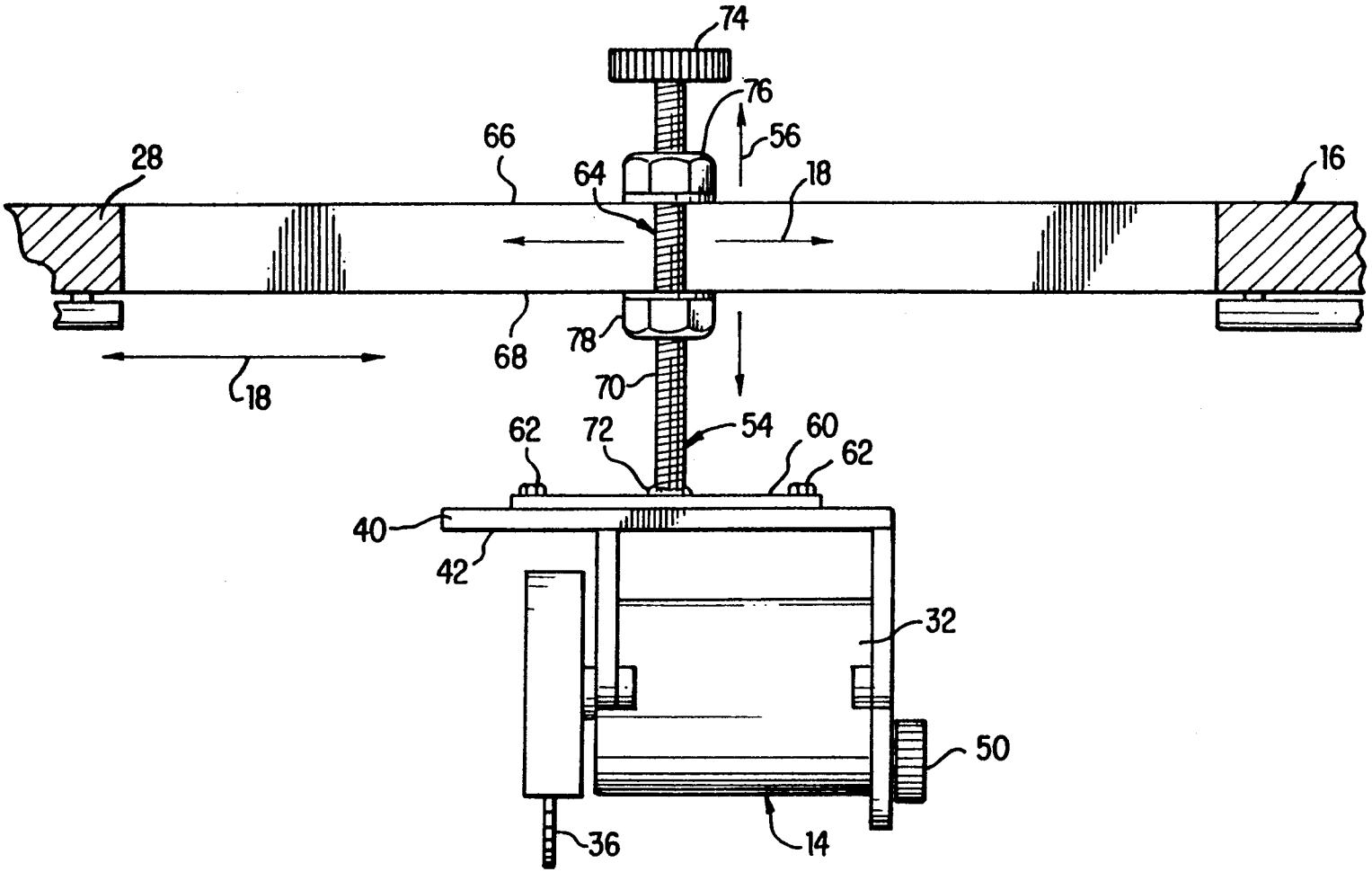
FIG. 3 is an elevational view of a first power saw mounting mechanism partially taken in cut-away; and, FIG. 4 is a perspective view of the workbench system showing a user cutting a workpiece thereon.

Power saw securement mechanism 38 includes power saw securement base member 40 with power saw 14 being mounted to upper surface 42 as is clearly seen in FIGS. 1 and 3. Power saw 14 is fixedly secured to power saw securement base member 40 through extension member 44 which may be secured to the back surface of power saw motor 32 in a number of conventional ways such as bolting, adhesive attachment, or welding. Extension member 44 is thus fixedly coupled to portable power saw 14. Base lug member 46 is fixedly coupled to power securement base member 40 at upper surface 42. Base lug member 46 may be arcuate in vertical contour to provide an arcuately directed lug through slot 48. Threaded securement knob 50 passes through base lug member 46 for threaded engagement with extension member 44 as is seen in FIG. 2. Threaded securement knob 50 is actuatable in arcuate direction 52 to particularly position portable power saw 14 at a particular predetermined orientation at the discretion of the user. Once angularly positioned as a function of a particular needed orientation, threaded securement knob 50 may be tightened to compress extension member 44 against base lug member 46 in frictional contact to maintain a fixed orientation of portable power saw 14 on power saw securement base member 40. Additionally, this provides for a complete securement of portable power saw 14 with respect to power saw securement mechanism 38.

Workbench system 10 further includes first power saw mounting mechanism 54 for adjustably and fixedly positioning portable power saw 14 above workpiece positioning member 30. First power saw mounting mechanism 54 as is depicted in FIG. 1, allows power saw securement mechanism 38 to be displaced in vertical direction 56 in a reversible manner and further permits power saw securement mechanism 38 to be reversibly displaced in longitudinal direction 18 through insert cooperation with longitudinally extending slot 58 as will be described in following paragraphs.

Referring now to FIGS. 1, 3 and 4, first power saw mounting mechanism 54 is slidably insertable within longitudinal slot 58 and displaceable in longitudinal direction 18. The mechanism for longitudinally and vertically displacing power saw securement mechanism 38 with respect to upper longitudinally directed frame bar member 28 includes contact plate member 60 which is releasably securable to power saw securement base member 40 through a series of contact plate member bolts 62 which threadedly engage power saw securement base member 40 as is seen in FIG. 3.

Additionally, first power saw mounting mechanism 54 further includes threaded securement mechanism 64 which extends through bar member longitudinal slot 68. Threaded securement mechanism 64 is coupled to an upper surface 66 as well as a lower surface 68 of upper longitudinally directed frame bar member 28. Threaded securement mechanism 64 includes bolt or threaded securement member 70 passing through longitudinal slot 58 and includes an overall outer diameter which is less than the width of slot 58 in order to allow the entire threaded securement mechanism to be moved in both vertical direction 56 as well as longitudinal direction 18 within longitudinal slot 58. Securement bolt 70 includes opposing ends where bolt first end 72 is rigidly coupled to contact plate member 60 through a fixed coupling such as welding or some like technique. Bolt second end 74 is a knoblike member rigidly coupled to the main body of securement bolt 70 to allow grasping and rotation thereof.

Additionally, a pair of nut members 76, 78 threadedly engage securement bolt 70 as is shown in the Figures. Nut members 76 and 78 contiguously are positioned on respective opposing upper and lower surfaces 66 and 68 of bar 28 in order to constrain threaded securement mechanism 64. Obviously, either of bolts 76 or 78 may be rotated in one direction to loosen the capturing of bar 28 and to allow longitudinal directional displacement of threaded securement mechanism 64 within longitudinal slot 58. Further, cooperative rotation between nuts 76 and 78 allows for vertical positioning of first power saw mounting mechanism 54 at the discretion of the user.

Workbench system 10 also includes second power saw mounting mechanism 80 for adjustably and fixedly positioning portable power saw 14 at least partially below workpiece positioning member 30. Referring to FIGS. 1 and 2, second power saw mounting mechanism 80 acts in cooperation with transversely directed slot 82 formed through workpiece positioning member 30 as is shown. In this manner, power saw 14 may be mounted underneath workpiece positioning member 30 and blade 36 can extend therethrough for interfacing and cutting workpiece 12 mounted thereon.

Second power saw mounting mechanism 80 includes L-shaped bracket members 84 mounted on opposing transverse sides or surfaces of workpiece positioning member 30. L-shaped bracket members 84 include cooperating ledges 86 upon which power saw securement mechanism 38 is mounted. In particular, power saw securement base member 40 is mounted on an upper surface of cooperating and transversely aligned ledges 86 of L-shaped bracket members 84 for insert and passage therethrough of blade 36 through slot 82 as is seen in FIG. 2.

L-shaped bracket members are fixedly secured to workpiece positioning member 28 through use of second bolt members 88 which are threadedly secured through power saw securement base member 40 and ledge members 86.

Rotation of L-shaped bracket members 84 about a transverse axis is seen to be accomplished through a pair of position lug members 90 mounted on rotatable shaft 92 and terminating in rotatable knob 94 which allows the user to rotate the entire power saw securement mechanism 38 about a limited angular displacement through slot 82. In this manner the user is given an adjustment for mitering an edge of workpiece 12 if needed.

When a user is completed with their particular operation where power saw 14 is mounted below positioning member 28, such can easily be removed from L-shaped bracket members 84 and repositioned above positioning member 28 as is shown in FIG. 1. In this manner, a user may dimension, and proceed with all cutting operations on-site even at a remote location without the necessity of taking workpieces 12 back to some central station where the cutting operation may be accomplished.

Workpiece positioning member 30 is generally a planar member having a central section 96 and opposing end sections 98 and 100 which are defined by respective openings 102 and 104. The openings 102 and 104 provide for a lighter weight overall positioning member 28 which is generally substantially planar in contour. Generally what is needed is a flat central section 96 upon which the positioning of workpieces 14 may be accomplished.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A workbench system for cutting workpieces placed thereon with a portable power saw, comprising:

(a) a workbench frame having a plurality of leg members interfacing with a base surface and a workpiece positioning member extending in a longitudinal direction;

(b) power saw securement means releasably coupled to said workbench frame for predeterminedly mounting said power saw to said workbench frame;

(c) first power saw mounting means for adjustably and fixedly positioning said portable power saw above said workpiece positioning member; and, (d) second power saw mounting means for adjustably and fixedly positioning said portable power saw at least partially below said workpiece positioning member.

2. The workbench system as recited in claim 1 where said workbench frame includes an upper longitudinally directed frame bar member secured on opposing longitudinal ends to said leg members.

3. The workbench system as recited in claim 2 where said upper longitudinally directed frame bar member includes a longitudinally extending vertical through slot formed therethrough.

4. The workbench system as recited in claim 3 where said power saw securement means includes:

(a) a power saw securement base member, said power saw being mounted to an upper surface of said power saw securement base member; and, (b) means for fixedly securing said power saw to said power saw securement base member.

5. The workbench system as recited in claim 3 where said means for fixedly securing said power saw includes:

(a) an extension member fixedly coupled to said power saw;

(b) a base lug member fixedly coupled to said power securement base member having a lug through slot; and, (c) a threaded securement knob member passing through said lug through slot for threaded engagement with said extension member.

6. The workbench system as recited in claim 5 where said lug through slot is arcuate in contour.

7. The workbench system as recited in claim 3 where said first power saw mounting means includes means for longitudinally and vertically displacing said power saw securement means with respect to said upper longitudinally directed frame bar member.

8. The workbench system as recited in claim 7 where said means for longitudinally and vertically displacing said power saw securement means includes:

(a) a contact plate member releasably securable to said power securement base member; and, (b) threaded securement means extending through said bar member vertical through slot, said threaded securement means being coupled to an upper and lower surface of said longitudinally directed frame bar member.

9. The workbench system as recited in claim 8 where said contact plate member is fixedly coupled to said threaded securement means.

10. The workbench system as recited in claim 9 where said contact plate member is welded to said threaded securement means at one end thereof.

11. The workbench system as recited in claim 8 where said threaded securement means includes:

(a) a threaded securement member extending through said bar through slot; and, (b) a pair of nut members threadedly engaged with said threaded securement member, said nut members contiguously positioned respectively on opposing upper and lower surfaces of said upper longitudinally directed frame bar member.

12. The workbench system as recited in claim 11 where said pair of nut members include a diameter greater than a width dimension of said bar member vertical through slot.

13. The workbench system as recited in claim 1 where said second power saw mounting means includes a pair of L-shaped bracket members aligned each to the other in a transverse direction, said L-shaped ledge members fixedly secured to said workpiece positioning member therebelow.

14. The workbench system as recited in claim 13 where said workpiece positioning member includes a blade slot for passage therethrough of a blade of said power saw.

15. The workbench system as recited in claim 14 where said second power saw mounting means is threadedly secured to said power saw securement means.

16. The workbench system as recited in claim 14 including means for rotatively actuating said power saw securement means when said power saw securement means is mounted on said pair of L-shaped bracket members.

17. The workbench system as recited in claim 1 where said workpiece positioning member includes a central section forming a substantially planar upper surface having a blade slot formed therethrough for at least partial passage of a blade of said power saw.

18. The workbench system as recited in claim 17 where said central section of said workpiece positioning member is positionally located between a pair of longitudinally displaced open end sections of said workpiece positioning member.

19. The workbench system as recited in claim 1 where said plurality of leg members include a first and second set of said leg members fixedly secured to said workpiece positioning member on opposing longitudinal ends thereof.

* * * * *